US007926211B2

(12) United States Patent
Zhu

(10) Patent No.: US 7,926,211 B2
(45) Date of Patent: Apr. 19, 2011

(54) ILLUMINATED DISPLAY WITH SIMULATED MOTION

(76) Inventor: Shiqi Zhu, Richmond, VA (US)

( * ) Notice: Subject to any disclaimer, the term of this patent is extended or adjusted under 35 U.S.C. 154(b) by 19 days.

(21) Appl. No.: 12/285,772

(22) Filed: Oct. 14, 2008

(65) Prior Publication Data

US 2009/0038188 A1 Feb. 12, 2009

Related U.S. Application Data

(63) Continuation-in-part of application No. 12/073,536, filed on Mar. 6, 2008, now Pat. No. 7,497,039, which is a continuation-in-part of application No. 11/901,352, filed on Sep. 17, 2007, now abandoned.

(51) Int. Cl.
*G09F 11/12* (2006.01)

(52) U.S. Cl. ..... 40/472; 40/524

(58) Field of Classification Search ..... 40/514–528, 40/471–472, 661, 716
See application file for complete search history.

(56) References Cited

U.S. PATENT DOCUMENTS 1,579,597 A * 4/1926 Craig ..... 40/438
2,102,474 A * 12/1937 Vincent et al. ..... 40/438
2,942,368 A * 6/1960 Gale ..... 40/772
4,741,119 A * 5/1988 Baryla ..... 40/594
4,835,661 A * 5/1989 Fogelberg et al. ..... 362/97.1
5,032,099 A * 7/1991 Chan ..... 446/175
5,222,315 A * 6/1993 Lovison ..... 40/765
5,664,352 A * 9/1997 Beckman ..... 40/545
5,979,096 A * 11/1999 Ferdinandsen et al. ..... 40/768
6,922,928 B2 * 8/2005 Shih ..... 40/438

* cited by examiner

*Primary Examiner* — Cassandra Davis
(74) *Attorney, Agent, or Firm* — John S. Hale; Gipple & Hale

(57) ABSTRACT

The invention is directed toward a decorative apparatus for presenting visual images having the appearance of motion constructed of a front panel picture member mounted to a rear panel housing. The front panel picture member is a rectangular glass pane painted on the front face to define a transparent window and a translucent photographic picture mounted on a rear face of the planar member and framed by a border painted on the front face. The rear panel housing has a drive motor mounted to the housing which is connected to a rotatable driving roller which is also mounted to the housing. A driven roller is mounted to the housing oriented parallel to driving roller with an endless loop of transparent film having random designs applied thereon engaging the rollers. A stationary blocking screen is mounted to the housing in front of the endless loop, the blocking screen defining transparent sections with undulating designs and opaque sections; and a light source mounted in the panel housing behind the endless loop of film to illuminate the loop of endless film and the photographic picture.

15 Claims, 6 Drawing Sheets

ILLUMINATED DISPLAY WITH SIMULATED MOTION

RELATED APPLICATIONS

This application is a continuation-in-part of application Ser. No. 12/073,536 filed Mar. 6, 2008 now U.S. Pat. No. 7,497,039 which is a continuation-in-part of application Ser. No. 11/901,352, filed Sep. 17, 2007 now abandoned, which claims priority to Chinese Patent Application Number 2006201315033, filed on Aug. 13, 2006.

STATEMENT REGARDING FEDERALLY SPONSORED RESEARCH OR DEVELOPMENT

Not applicable.

REFERENCE TO SEQUENCE LISTING, A TABLE OR A COMPUTER PROGRAM LISTING COMPACT DISC APPENDIX

None.

BACKGROUND OF THE INVENTION

1. Field of Invention

The present invention relates to an illuminated scene with inspirational words and more particularly to an illuminated photographic scene giving the appearance of motion of a portion of the scene while the rest of the scene is static.

2. Background of the Invention

Kinetic decorative objects simulating an illuminated scene having the appearance of motion such as an aquarium are known in the prior art. Typically these devices include an endless loop of transparent or translucent material driven between two rollers. Depictions of marine life are printed on the endless loop and rotation of the loop over the rollers simulates motion.

In the prior art, illuminated picture display apparatus use a dynamic film endless loop and a fixed background picture interposed within the loop in order to show its effect on single layer pictures. The displayed picture of these devices is generally a single layer picture which remains stationary while fish, birds or the like printed on the film endless loop are used to impart motion to the scene.

Illuminated photographs are also known in the art. However, a problem which occurs is having the photograph centered in the frame and correctly bordered without the picture being angled, tilted or slipping. Furthermore when the scene is painted on either front of the glass panel which is illuminated on the back of the glass panel the scene loses resolution and color vibrancy.

What is needed is a more realistic simulation of a scene with a clear picture with a part of the scene giving an appearance of motion while the rest of the scene is static.

SUMMARY OF THE INVENTION

The invention is directed toward a decorative apparatus for presenting an illuminated visual image on a stationary background which has portions of the image with the appearance of motion. The decorative illuminated display apparatus is constructed with a front panel picture member mounted to a rear panel housing. The front panel picture member is a rectangular glass pane which is painted on its front face to define a transparent window with an opaque border with a translucent photographic picture adhesively mounted on a rear face of the planar member, the picture being framed by the border painted on the front face. The rear panel housing contains a drive motor mounted to the housing which is connected by a shaft to a rotatable driving roller which is also mounted to the housing. A driven roller is mounted to the housing oriented parallel to a driving roller with an endless loop of transparent film having random designs applied thereon encircling and engaging the both of the rollers. A stationary blocking screen is mounted to the housing behind the picture member in front of the endless loop of transparent film, the blocking screen defining transparent sections with undulating designs and opaque sections. An illumination light source is mounted in the panel housing behind the endless loop to illuminate the loop of endless loop of transparent film, the stationary blocking screen and the photographic picture.

It is an object of the invention to provide a clear illuminated picture scene with a portion of the scene having an appearance of motion.

It is another object of the invention to paint the front panels of the display apparatus so that a border is created framing a photographic picture which is adhesively mounted to the rear of the front panel.

It is still another aspect of the invention to apply inspirational messages on the front panel to be viewed by the viewer.

It is yet another object of the invention to provide a screen which blocks a portion of the endless loop keeping light from being transmitted to portions of the illuminated picture.

These and other objects, advantages, and novel features of the present invention will become apparent when considered with the teachings contained in the detailed disclosure along with the accompanying drawings.

DESCRIPTION OF THE INVENTION

Figure 1:
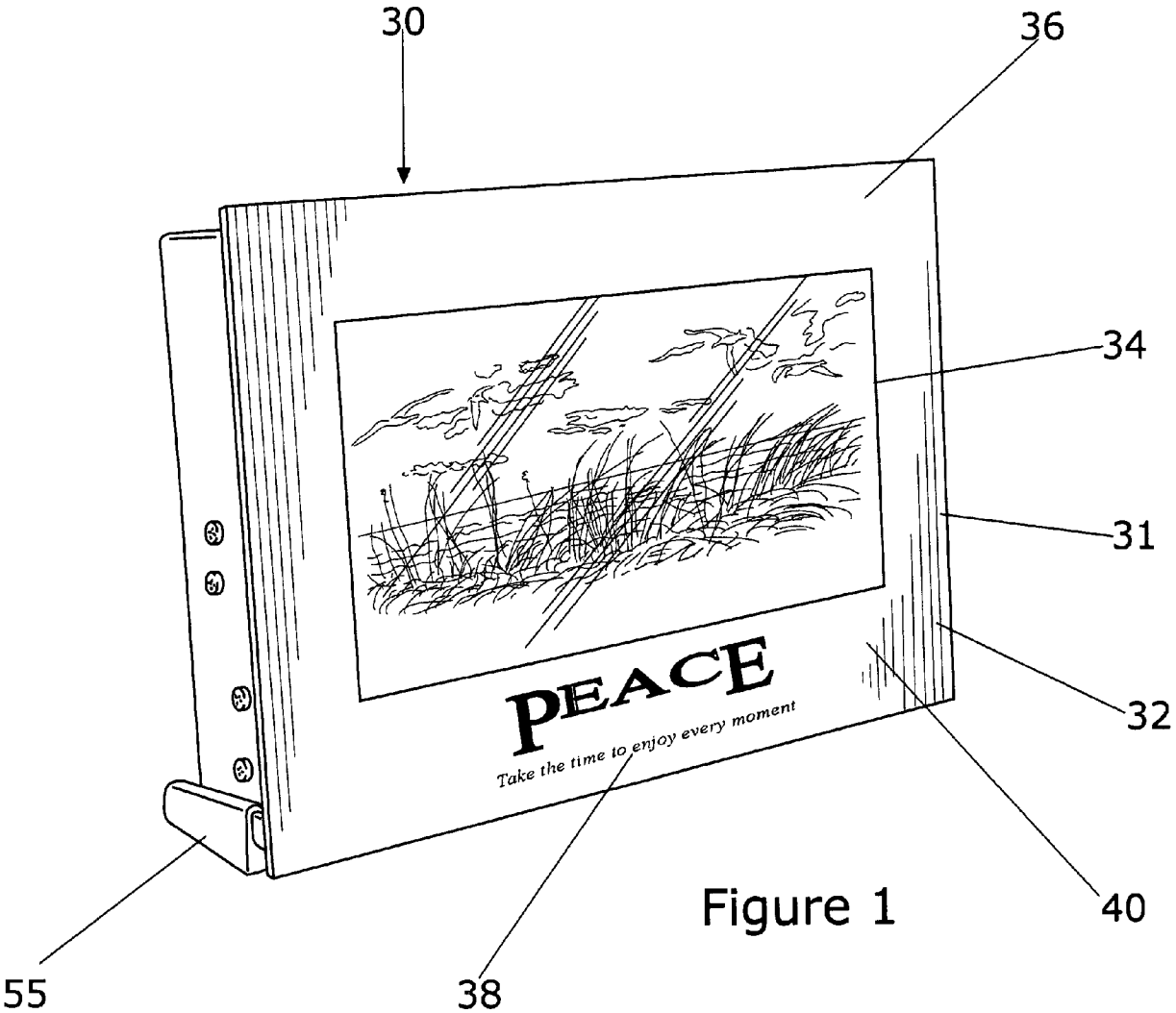
FIG. 1 is a perspective view of a display apparatus having an illuminated picture scene with the appearance of movement and showing an inspirational message.

The subject of the present invention is directed towards a display apparatus with an illuminated photographic scene and an inspirational message which presents a portion of the scene as simulating movement. The photograph is mounted to the rear face of a glass front panel by adhesive or tape and a painted border is applied to the front surface of the glass panel to frame the scene and present an inspirational message. The preferred embodiment and best mode of the invention is shown in FIGS. 1-8.

Referring to FIGS. 1 through 8, the illuminated scenic display apparatus 20 with inspirational language or a message 38 is constructed with a front panel 30 and a base panel housing 50 which is mounted to the front panel 30. The base panel housing 50 may be constructed from any moldable material, but in a preferred embodiment, is constructed from plastic, including but not limited to various nylon formulations, polyvinyl chloride, polyethylene, polyfluoroethylene, polypropylene, polymethyl methacrylate, and other acrylics, silicones, polyurethanes, or their composites.

Figures 2, 3:
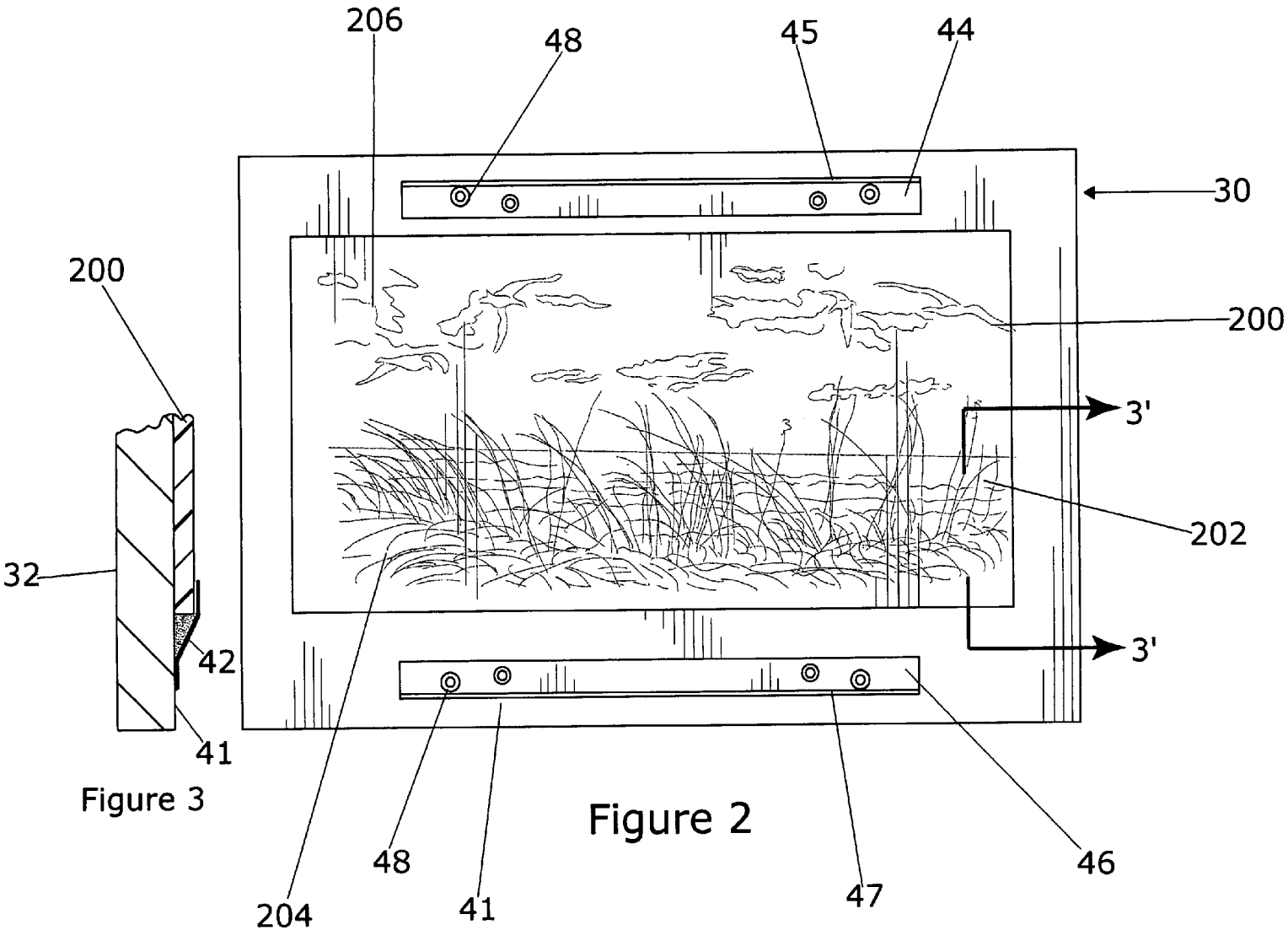
FIG. 2 is an elevated rear view of the front panel of the display apparatus shown in FIG. 1.
FIG. 3 is an enlarged partial cross sectional view taken along lines 3' 3' of FIG. 2.
Figure 4:
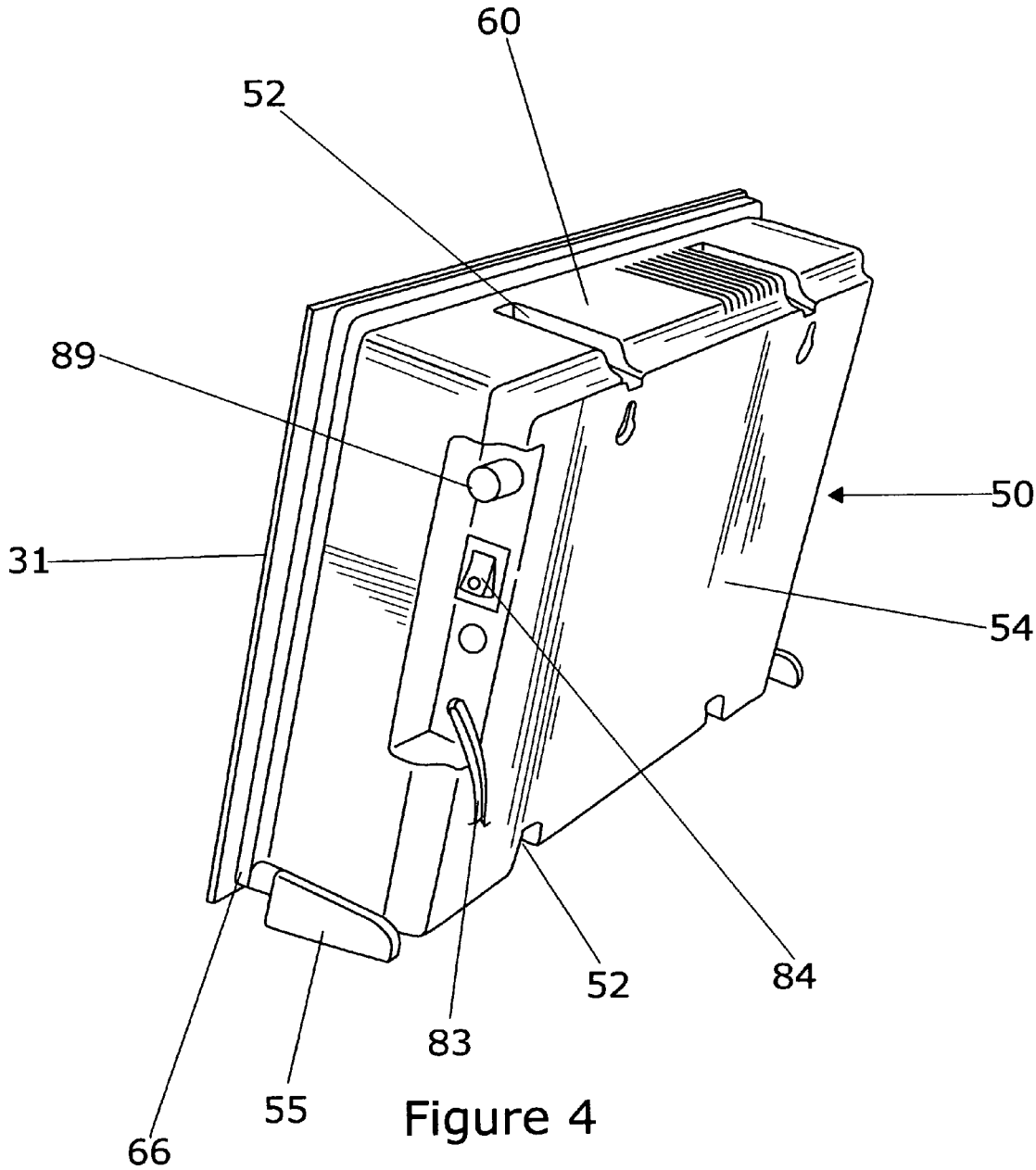
FIG. 4 is a rear perspective view of the display apparatus of FIG. 1.

The front panel 30 is preferably constructed of a one piece rectangular planar glass member 32 having a front face 31 with a pre-painted scene border 34 and a painted border section 36 presenting the appearance of an exterior of a frame. The area inside the scene border 34 is clean and transparent forming a framed window allowing the photograph 200 to be illuminated and clearly visualized. Inspiration words and messages 38 are painted on the bottom of the border section 36 as shown in FIG. 1. The glass member 32 has a rear face 41 and a translucent photograph 200 is mounted to the rear face 41 by an adhesive 42 as is seen in detail in FIG. 3. The adhesive can be in the form of any suitable adhesive wither of a liquid or viscous nature or including clear adhesively based tape for securing a Mylar, plastic or translucent photograph 200 onto the surface of glass member 32. It is important that the adhesive not show an edge which will be transmitted through the photograph 200 as a line or dark spot to the viewer. It will also be appreciated that, in the illustrated example, the photograph 200 has a scene with a water component 202 which, as will later be explained, has the appearance of motion while the other scene components, namely, the land/vegetation component 204 and sky component 206 appear to the viewer to be stationary. Two L-shaped support and orientation brackets 44 and 46 are secured to the rear face 41 of the glass member 32 by adhesive in a parallel orientation as shown in FIG. 2, at the top and bottom border sections of the member 32 so that the outwardly extending legs 45 and 47 of the respective brackets fit inside the chamber 63 adjacent the top and base with bosses 48 formed on each of the brackets 44 and 48 being positioned adjacent the channel guides 52 formed on the top and the bottom of the base panel housing 50 as shown in FIG. 4. As noted, each of brackets 44 and 46 defines two spaced bosses 48 which have an internal threaded bore to receive screws (not shown) which are inserted through the channel guides 52 into the threaded bosses 48.

Figure 5:
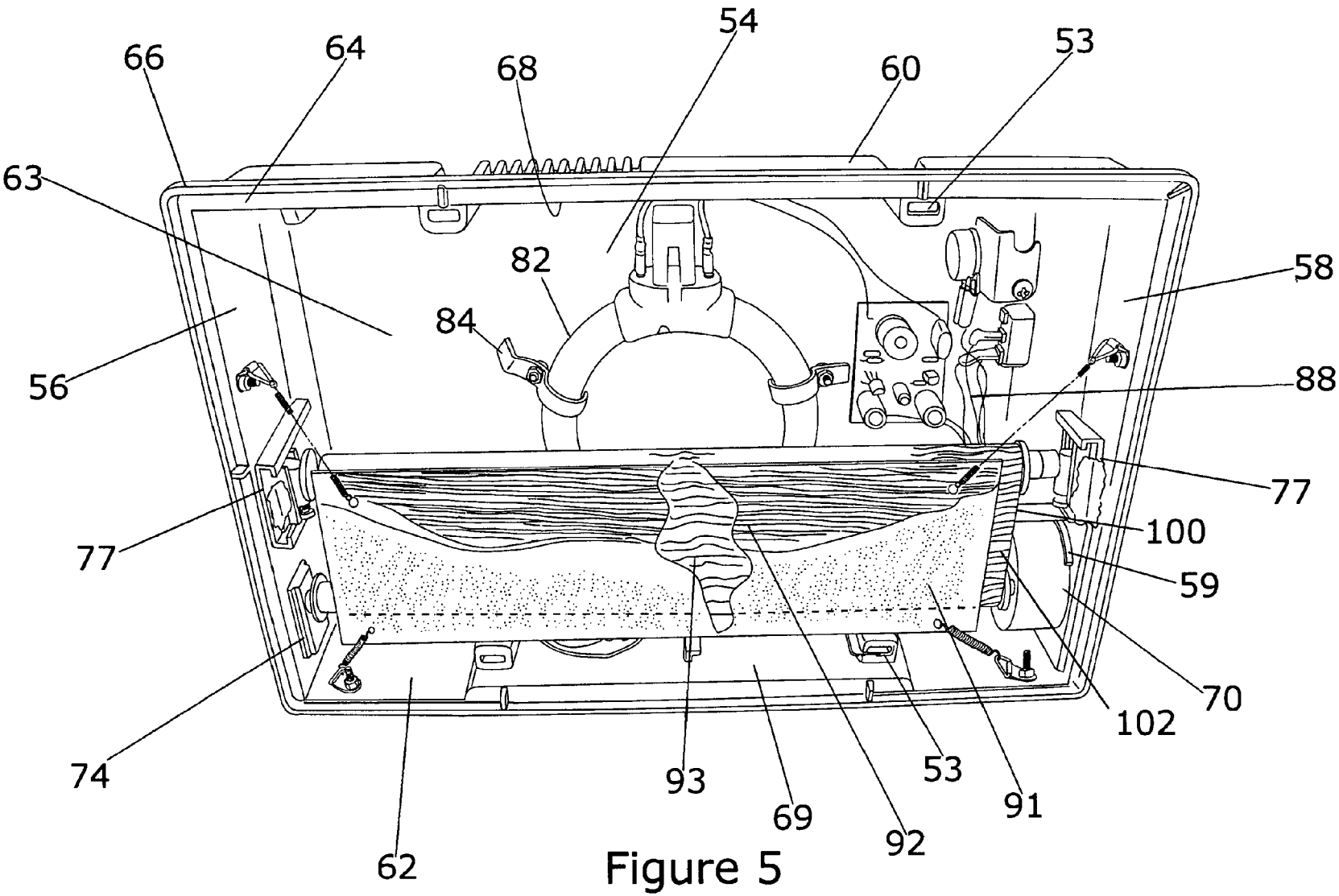
FIG. 5 is a perspective view of the base panel housing of the display apparatus shown in FIG. 1 with the front panel removed.
Figure 6:
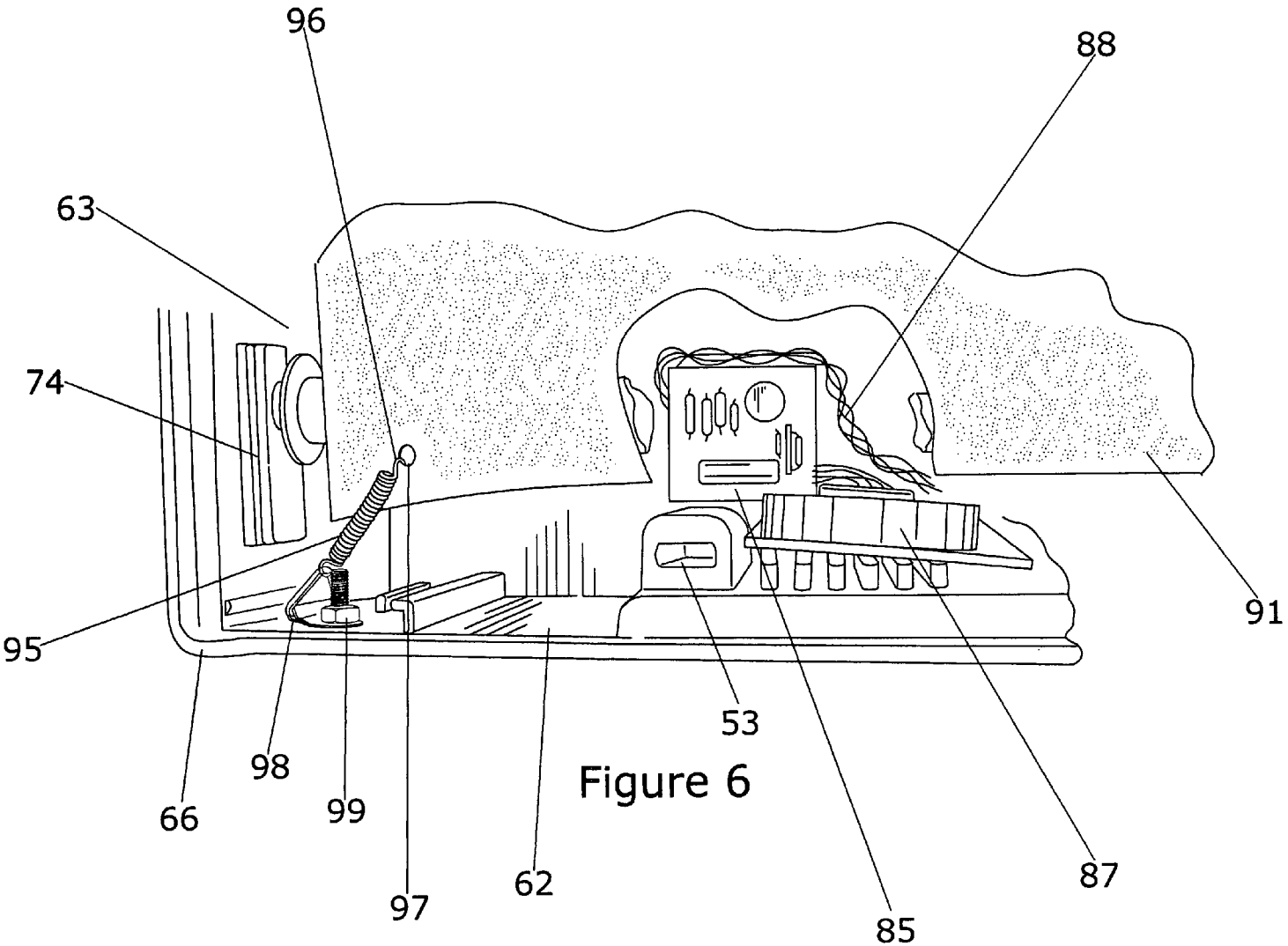
FIG. 6 is an enlarged partial perspective view of the left corner of the base panel housing shown in FIG. 5 with a section of a blocking screen removed.

Referring now to FIGS. 4-6, the rear panel housing 50 is formed with a rear wall 54, opposing sidewalls 56 and 58, a top 60 and a base 62 which together form chamber 63. The open edge of the opposing sidewalls 56, 58, and interconnecting top 60 and base 62, form a seat 64 having an outwardly extending flange 66 which extends around the face of the rear panel housing as is shown in FIG. 5. Inner surface 68 formed in the top 60 and the platform 69 formed on the base 62 receive legs 45 and 47 of the top panel 30. Screws are placed in the channels 52 through the rear panel housing and extend through entry apertures 53 for threading into bracket bosses 58. Rear panel housing 50 is provided with stabilizer legs 55 which are mounted on the exterior surface of the sidewalls 56, 58 of the housing as is shown in FIG. 4.

Figure 7:
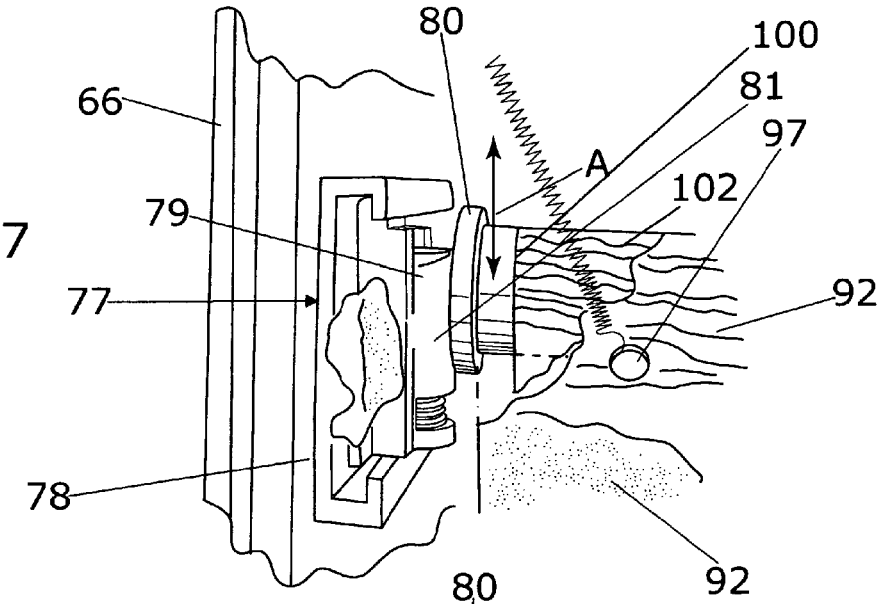
FIG. 7 is an enlarged partial perspective view of FIG. 5 showing one side of the driven roller with a section of the blocking screen removed.
Figure 8:
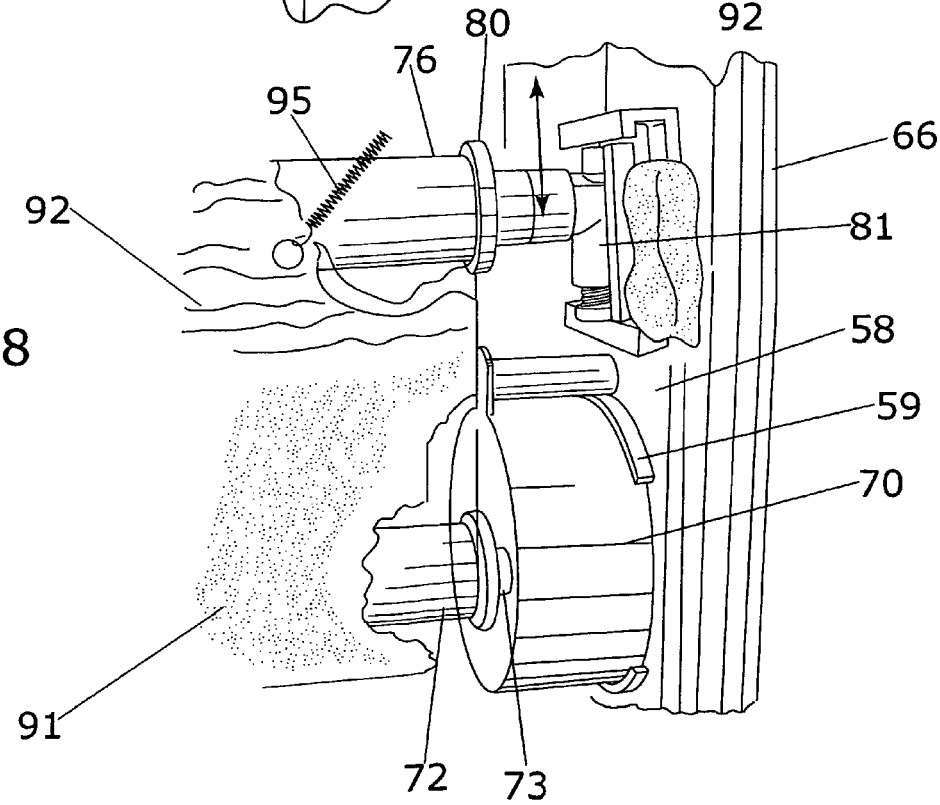
FIG. 8 is an enlarged partial perspective view of FIG. 5 showing the drive and driven rollers on the opposite side of the apparatus from the side shown in FIG. 7 with a section of the blocking screen and endless loop removed.

A roller drive mechanism in the form of an electrical motor 70 is mounted in the housing 50. The motor 70 is mounted on the sidewall 58 in a circular rib seat 59 with shaft 73 having an axis generally transverse to the plane of both sidewalls. A driving roller 72 is mounted co-axially by shaft 73 to the arbor of motor 70 and is mounted to the housing 50 at its distal end as shown in FIG. 5 in a seat assembly 74 permitting rotation of the roller 72. A driven roller 76 is mounted to sidewalls 56 and 58 via a spring biased slideable secured roller mount assembly 77 at each sidewall of the housing as shown in FIGS. 5, 7 and 8. The assembly 77 is seated in a groove formed in both ends of support member 78 and secured in place. This allows the spring biased roller support member 79 to selectively tension the endless loop 100 in the direction shown by arrow A in FIG. 7. A transparent film 100 forming an endless loop is mounted over and functionally engaged with both the driving roller 72 and driven roller 76, with the transparent film interior surface of the endless loop positively engaging the exterior surface of the rollers. The coil spring of the spring member 79 constantly biases the driven roller 76 away from the driving roller 72 causing the endless loop of film 100 to be continuously tensioned between both rollers thus transferring the driving force of roller 72 to the driven roller 76.

Referring to FIGS. 7 and 8, ring collars 80 constructed from a resilient material are mounted in a fixed position at the ends of each roller to hold the transparent film 100 in position on the rollers and keep the same from horizontally moving across the surface of the rollers into the sidewalls of the housing 50. As noted the ring collars 80 prevent the film 100 from slipping along the axis of the driven roller 76. The surface of film 100 is marked or painted with a plurality of undulating irregularly spaced lines 102 across its horizontal surface which provides the appearance of motion to selected areas of the photograph 200 as the endless loop of transparent file 100 is rotated.

A light source 82 in the form of an oval fluorescent tube is held in place on the rear wall 54 by brackets 84. The motor 70 and light source 82 are activated by a switch 84 which transmits power from a standard electrical socket (not shown) through an electrical cord 83 to a circuit which functions as a fluorescent starter for the fluorescent tube. When the switch 84 is turned on, power is transmitted via power cord 83 through electrical wiring 88 to the motor 70, light source 82 and sound circuit 85 which produces suitable sounds which correspond to the image shown on the scene depicted by photograph 200 through speaker 87. For the illustrated embodiment shown, the sounds of waves crashing on a beach and crying of seagulls would be heard. Volume of the sound is controlled by volume control knob 89 located above switch 84 as shown in FIG. 4.

A blocking screen 90 having a generally rectangular sheet form is mounted to the housing 50 between the endless loop of transparent film 100 and the photograph 200. The blocking screen 90 is preferably a sheet of film having opaque areas 91 and transparent areas 92 having a design imprinted thereon in the form of a plurality of undulating lines 93 as seen in FIG. 4. The blocking screen 90 is mounted to the housing 50 by a plurality of spring assemblies 94 as most clearly shown in FIGS. 5 and 6. The spring assemblies consist of a coil spring 95 having a curved distal end 96 hooked in a corner aperture 97 formed in each corner of the blocking screen 90. The proximal end of the coil spring is hooked on a spring seat 98 which is mounted to the base 62 of housing 50 by a bolt 99.

The principles, preferred embodiments and modes of operation of the present invention have been described in the foregoing specification. However, the invention should not be construed as limited to the particular embodiments which have been described above. Instead, the embodiments described here should be regarded as illustrative rather than restrictive. Variations and changes may be made by others without departing from the scope of the present invention as defined by the following claims:

What is claimed is:

1. A decorative apparatus for presenting an illuminated photograph having the appearance of motion comprising:

a rear panel housing having a rear wall, opposing sidewalls, a top and base;

a front panel picture member mounted to said rear panel housing; said front panel picture member having a generally planar rear surface with a plurality of bracket members, said front panel picture member comprising a rigid transparent planar member, said front panel picture member being painted on the front face to define an opaque border and a transparent window and a translucent picture is mounted on a rear face of said front panel picture member framed by said painted front face border;

a drive mechanism mounted to said housing;

a driving roller connected to said drive mechanism and rotatably mounted to said housing;

a driven roller rotatably mounted to said housing, said driven roller being oriented parallel to said driving roller;

an endless loop of transparent film having a random design applied thereon, said transparent film having an interior surface and an exterior surface, said interior surface being in communication with said driving and driven rollers, said transparent film being rotatably driven around said rollers;

a blocking screen mounted to said housing; said blocking screen being positioned in front of said endless loop of film and having at least one transparent section with a plurality of aligned undulating lines and at least one opaque section;

an illumination light means mounted in said rear panel housing behind said loop of endless film to illuminate said loop of endless file and said picture; and, said blocking cover at least one transparent section has a random design thereon in the form of a plurality of undulating lines.

2. A decorative apparatus as claimed in claim 1 wherein a sound generation assembly is mounted in said rear panel housing.

3. A decorative apparatus as claimed in claim 1 wherein said endless loop random design is a plurality of spaced undulating lines.

4. A decorative apparatus as claimed in claim 1 wherein said translucent picture is a rigid transparent planar member with front and rear planar surfaces and a photographic image mounted on said rear planar surface.

5. A decorative apparatus as claimed in claim 1 wherein said illumination means is a fluorescent lamp.

6. A decorative apparatus as claimed in claim 1 wherein said picture is a photographic landscape scene which has at least one section which depicts water and at least one section with a non-water scene and said blocking screen is mounted behind said picture, said blocking screen having at least one transparent section adjacent to said at least one water section and at least one opaque section covering a non-water scene of the picture.

7. A decorative apparatus as claimed in claim 1 wherein said bracket members define a plurality of threaded bosses.

8. A decorative apparatus as claimed in claim 1 wherein said blocking screen is substantially rectangular and is mounted to said rear panel housing by spring means mounted to each corner of said blocking screen.

9. A decorative apparatus as claimed in claim 1 wherein said rigid transparent planar member is a rectangular pane of glass.

10. A decorative apparatus as claimed in claim 1 wherein said rear panel housing has a support leg mounted to each of said opposing side walls.

11. A decorative apparatus for presenting visual photographic images with the appearance of motion comprising:

a rear panel housing having a rear wall, opposing sidewalls, a top and base;

a front panel picture member mounted to said rear panel housing; said picture member comprising a rigid transparent planar member, said member being painted on the front face to define a border forming a transparent window and a translucent photographic picture mounted on a rear face of said planar member and being framed by said border;

a drive mechanism mounted to said housing;

a driving roller connected to said drive mechanism and rotatably mounted to said housing;

a driven roller rotatably mounted to said housing, said driven roller being mounted to said housing with spring means outwardly biasing said driven roller against an endless loop of transparent film, said driven roller being oriented parallel to said driving roller;

said endless loop of transparent film having a random design applied thereon and having an interior surface and an exterior surface, said interior surface being in communication with said driving and driven rollers and being rotatably driven;

a blocking screen mounted to said housing; said blocking cover being positioned in front of said endless loop of transparent film and being formed with at least one transparent section and at least one opaque section and is provided with an undulating linear design;

a light means mounted in said rear panel housing to illuminate said loop of endless film; and a sound generating assembly mounted in said rear panel housing.

12. A decorative apparatus as claimed in claim 11 wherein said picture depicts a water scene and said blocking screen at least one transparent section is positioned adjacent said water scene in said picture.

13. A decorative apparatus as claimed in claim 12 wherein said front face of said front panel picture member contains inspirational wording.

14. A decorative apparatus with an illuminated picture having a water scene with the appearance of motion comprising;

a front panel picture member mounted to a rear panel housing, said front panel picture member constructed of a rectangular glass pane painted on a front face to define a transparent window and a translucent photographic picture mounted on a rear face of said planar member by adhesive means, said picture being framed by a border painted on a front face said pane, a pair of mounting brackets secured to said rear face of said glass panel and orientated parallel to each other, said brackets being provided with bosses with threaded bores to receive screws inserted through said rear panel housing to hold the front panel picture member and rear panel housing together, said rear panel housing being constructed with a rear wall, opposing sidewalls, a top and a base, a drive motor mounted to the housing is connected to a rotatable driving roller, a driven roller is mounted to said housing with spring means outwardly biasing said driven roller against said endless loop of transparent film, said driven roller being rotatably mounted to the housing oriented parallel to driving roller and an endless loop of transparent film having random designs applied is mounted on the outer surfaces of the driving and driven rollers, the transparent film being rotatably driven by said driving roller, a stationary blocking screen is mounted to the housing between the photographic picture and said endless loop of transparent film, said blocking screen defining at least one transparent section with undulating designs which are positioned next to the water scene of said picture and at least one opaque section positioned next to the non water scene portion of said picture; and a light source mounted in the rear panel housing behind the endless loop of transparent film to illuminate the loop of endless film and said photographic picture.

15. A decorative apparatus as claimed in claim 14 wherein said front face of said front panel picture member contains inspirational wording.

* * * * *